US010767954B1

(12) United States Patent
Howard

(10) Patent No.: US 10,767,954 B1
(45) Date of Patent: Sep. 8, 2020

(54) BARREL HARMONIZING ASSEMBLY AND METHOD

(71) Applicant: Charles M. Howard, Tulsa, OK (US)

(72) Inventor: Charles M. Howard, Tulsa, OK (US)

( * ) Notice: Subject to any disclaimer, the term of this patent is extended or adjusted under 35 U.S.C. 154(b) by 0 days.

(21) Appl. No.: 16/512,675

(22) Filed: Jul. 16, 2019

(51) Int. Cl.
*F41A 21/44* (2006.01)

(52) U.S. Cl.
CPC ..... *F41A 21/44* (2013.01)

(58) Field of Classification Search
CPC ..... F41A 21/44; F41A 21/32
USPC ..... 42/76.01, 77
See application file for complete search history.

(56) References Cited

U.S. PATENT DOCUMENTS 2,302,699 A * 11/1942 Klipsch ..... F41C 27/22 42/97
3,340,641 A 9/1967 Recker
5,423,145 A 6/1995 Nasset
5,509,345 A * 4/1996 Cyktich ..... F41A 21/325 42/97
RE35,381 E * 11/1996 Rose ..... F41A 21/36 89/14.3
5,661,255 A * 8/1997 Webb, III ..... F41C 27/00 42/1.06
5,698,810 A * 12/1997 Rose ..... F41C 27/22 89/14.3
5,860,242 A * 1/1999 O'Neil ..... F41C 27/22 42/75.01
2010/0132241 A1 6/2010 Mancini
2016/0334181 A1* 11/2016 Bennington ..... F41A 21/32

* cited by examiner

*Primary Examiner* — Samir Abdosh
(74) *Attorney, Agent, or Firm* — Dennis D. Brown; Brown Patent Law, P.L.L.C.

(57) ABSTRACT

A barrel harmonizing assembly and method for a firearm in which a cylindrical harmonizer sleeve, as well as a pair of tuning nuts which are threadedly positioned on the harmonizer sleeve for longitudinal tuning movement, are positioned around the barrel, rather than projecting from the forward end of the barrel, in order to provide improved tuning and to permit the use, as part of the assembly, of a flash hider, a recoil compensator, a suppressor or other device on the end of the barrel to further improve the accuracy of the barrel and/or provide other benefits.

20 Claims, 2 Drawing Sheets

BARREL HARMONIZING ASSEMBLY AND METHOD

FIELD OF THE INVENTION

The present invention relates to barrel harmonizing assemblies and methods for improving the accuracy of rifles and other firearms.

BACKGROUND OF THE INVENTION

Barrel harmonics refers to the manner in which the barrel of a rifle or other firearm whips, torques and contorts when tiring. The point in time at which the bullet exits the barrel will determine the discharge orientation of the muzzle relative to its rest position prior to firing. If the bullet exits the muzzle near a peak or valley in the barrel motion, the muzzle will be relatively stationary at the instant when the bullet leaves the barrel, and shot dispersion will be minimized. Once the barrel reaches the upper or lower limit of its travel (crest or trough), the barrel, for the briefest of moments, is completely stationary, allowing a bullet that exits at that exact moment to move straight ahead, although not directly in line with the barrel's at-rest position prior to firing.

If, on the other hand, the bullet exits the barrel at a point in time in which the barrel is whipping or moving rapidly between the peak and valley positions of the muzzle, the resulting shot dispersion will be greater.

Historically, virtually the only way to control or adapt to the barrel vibrations that affected the accuracy of a rifle was to custom load the ammunition until a correct combination of cases, bullets, primers, powders, seating depths, etc. could be found that would allow the rifle to shoot in tight, consistent groups. It is known that, in addition to affecting the accuracy of the rifle in other ways, the internal ballistics of a given cartridge affect its dwell time in the barrel, i.e., the time it takes for the bullet to exit the barrel after ignition. By experimentally matching the dwell time of the bullet to the barrel's frequency, the best ammunition load for a particular firearm may be found.

Unfortunately, because the best ammunition loads for purposes of barrel harmonics can differ significantly even between otherwise identical rifles of the same model, complicated experimental techniques for determining the optimum internal ballistics of the ammunition must be performed for each individual rifle. The hand loading techniques and firing tests required for this determination are time consuming and hazardous, and require experience and the purchase of expensive equipment.

More recently, various devices have been marketed which, instead of formulating an ammunition load to match the harmonics of the barrel, attempt to tune the harmonics of the barrel to match a given ammunition. One type of device heretofore known in the art uses an adjustable damper or pressure bedding point which purportedly allows the shooter to find a "sweet spot" for damping the vibrations of the barrel that are affecting accuracy. Other tuners work by using an adjustable weight on the muzzle to alter the length of the resonant portion of the barrel.

Unfortunately, although some success has been achieved with these prior devices, the prior devices typically are attached to, and project a significant distance from, the forward end of the barrel so that the prior devices are prone to damage, present a significant obstruction on the end of the barrel, are prone to easily becoming out of tune, must be frequently retuned, and obstruct the use of a flash hider, suppressor, recoil compensator, or other external device on the end of the barrel which could further improve the accuracy of the barrel and/or provide other benefits.

Consequently, a need exists for an improved barrel harmonizing assembly which (a) will provide significantly greater accuracy, (b) will be inexpensive and easy to use. (c) can be used on any type of rifle, (d) does not extend from the forward end of the barrel, and (e) will not prevent or interfere with the use of flash hiders, suppressors, recoil compensators and other external devices which can also be used to improve the accuracy and/or operation of the firearm.

SUMMARY OF THE INVENTION

The present invention provides a barrel harmonizing assembly and method which satisfy the needs and alleviate the problems identified above.

In one aspect, there is provided a harmonizing assembly which preferably comprises: (a) a cylindrical sleeve having an internal passageway extending therethrough configured to receive, and to position the cylindrical sleeve around an exterior of, a longitudinal portion of a barrel of a firearm, the cylindrical sleeve having threads around at least a portion of a longitudinal exterior of the cylindrical sleeve: (b) a first tuning nut which is threadedly received around, and is longitudinally repositionable along, the longitudinal exterior of the cylindrical sleeve; (c) a second tuning nut which is threadedly received around, and is longitudinally repositionable along, the longitudinal exterior of the cylindrical sleeve, the second tuning nut being threadedly tightenable against the first tuning nut; and (d) an inwardly extending radial shoulder at a forward longitudinal end of the cylindrical sleeve, wherein (i) the inwardly extending radial shoulder at the forward longitudinal end of the cylindrical sleeve is configured to allow an externally threaded forward end segment of the barrel to be delivered through the inwardly extending radial shoulder such that the inwardly extending radial shoulder of the sleeve is retained by an exterior shoulder of the barrel, (ii) the externally threaded forward end segment of the barrel has a reduced outer diameter, and (iii) the exterior shoulder of the barrel is located at a reward longitudinal end of the externally threaded forward end segment of the barrel.

In another aspect, the harmonizing assembly preferably comprises a threaded retainer which is threadedly receivable on the externally threaded forward end segment of the barrel to retain the cylindrical sleeve around the exterior of the longitudinal portion of the barrel. The threaded retainer is preferably a locknut, jam nut, flash hider, recoil compensator, or suppressor.

In another aspect, the harmonizing assembly preferably further comprises a bonding agent applied between an interior surface of the internal passageway of the cylindrical sleeve and the exterior of the longitudinal portion of the barrel.

In another aspect, there is provided an assembly for a firearm which preferably comprises: (a) a barrel of a firearm; (b) a cylindrical harmonizer sleeve positioned around an exterior of a longitudinal portion of the barrel, the cylindrical harmonizer sleeve having threads around at least a portion of a longitudinal exterior of the cylindrical harmonizer sleeve; (c) a first tuning nut which is threadedly received around, and is longitudinally repositionable along, the longitudinal exterior of the cylindrical harmonizer sleeve; (d) a second tuning nut which is threadedly received around, and is longitudinally repositionable along, the longitudinal exterior of the cylindrical sleeve, the second tuning nut being threadedly tightenable against the first tuning nut; and (e) the cylindrical harmonizer sleeve having an inwardly extending radial shoulder at a forward longitudinal end of the cylindrical harmonizer sleeve through which an externally threaded forward end segment of the barrel projects, wherein: (i) the inwardly extending radial shoulder at the forward longitudinal end of the cylindrical harmonizer sleeve is retained by an exterior shoulder of the barrel, (ii) the externally threaded forward end segment of the barrel has a reduced outer diameter, and (iii) the exterior shoulder of the barrel is located at a reward longitudinal end of the externally threaded forward end segment of the barrel.

In another aspect, there is provided a method of harmonizing a barrel of a firearm. The method preferably comprises the step of (a) placing a harmonizing sleeve assembly on the barrel wherein the harmonizing sleeve assembly preferably comprises: (i) a cylindrical sleeve which is positioned around an exterior of a longitudinal portion of the barrel, the cylindrical sleeve having threads around at least a portion of a longitudinal exterior of the cylindrical sleeve and the cylindrical sleeve having an inwardly extending radial shoulder at a forward longitudinal end of the cylindrical sleeve through which an externally threaded forward end segment of the barrel projects, the externally threaded forward end segment of the barrel having a reduced outer diameter, (ii) a first tuning nut which is threadedly positioned around the longitudinal exterior of the cylindrical sleeve at a longitudinal tuning location, and (ii) second tuning nut which is threadedly positioned around the longitudinal exterior of the cylindrical sleeve and is tightened against the first tuning nut at the longitudinal tuning location.

In addition, the method preferably further comprises the steps of: (b) retaining the harmonizing sleeve assembly on the barrel by threadedly tightening a threaded retainer on the externally threaded forward end segment of the barrel such that the inwardly extending radial shoulder at the forward longitudinal end of the cylindrical sleeve is held in fixed position between the threaded retainer and an exterior shoulder of the barrel which is located at a reward longitudinal end of the externally threaded forward end segment of the barrel; (c) firing a plurality of shots from the barrel to determine a grouping of the shots; and (d) moving the first and second tuning nuts longitudinally to a different longitudinal tuning location around the exterior of the cylindrical sleeve to obtain a tighter grouping of shots.

Further aspects, features and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
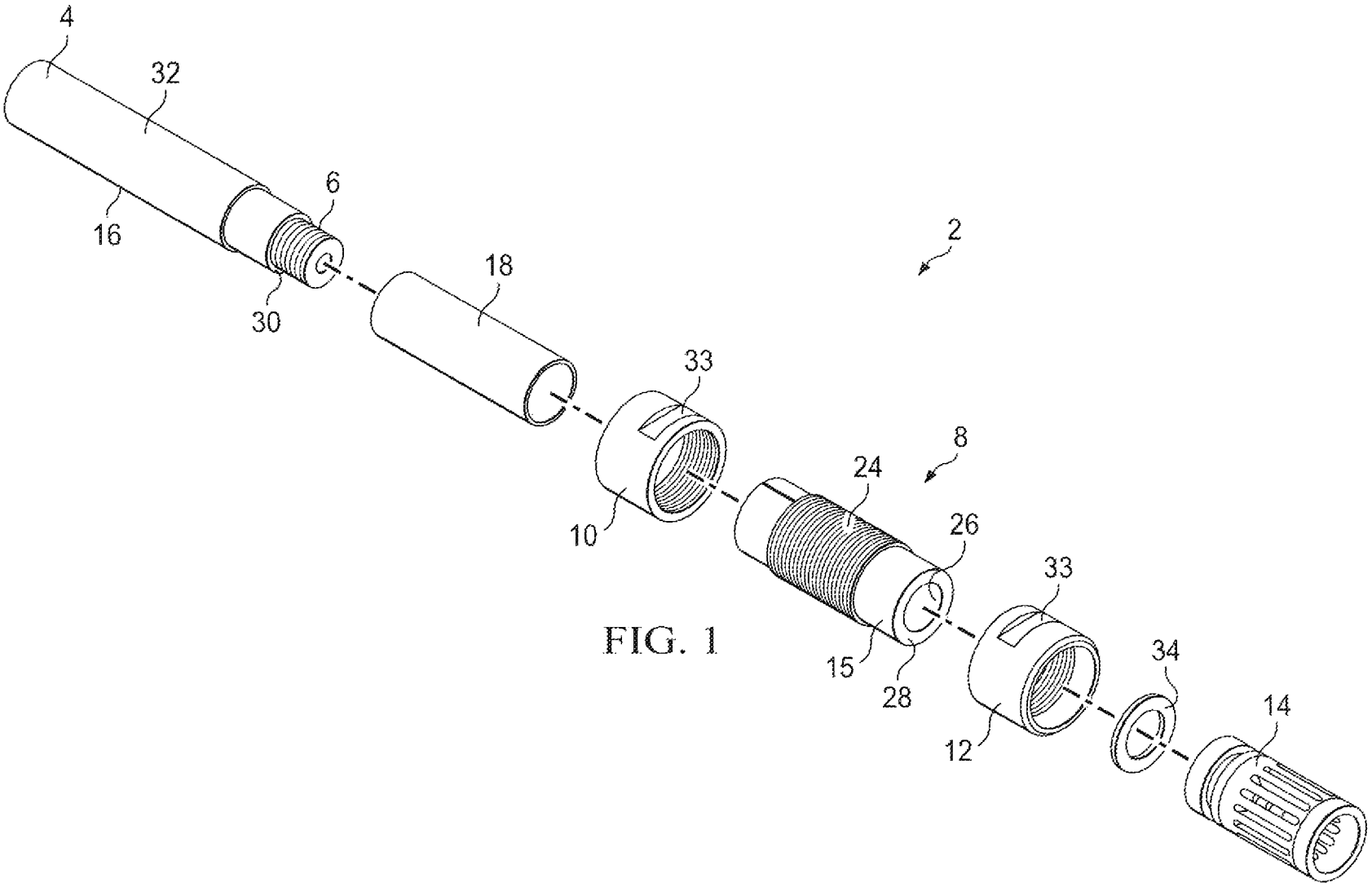
FIG. 1 is an exploded view of an embodiment 2 of the barrel harmonizing assembly provided by the present invention.
Figure 2:
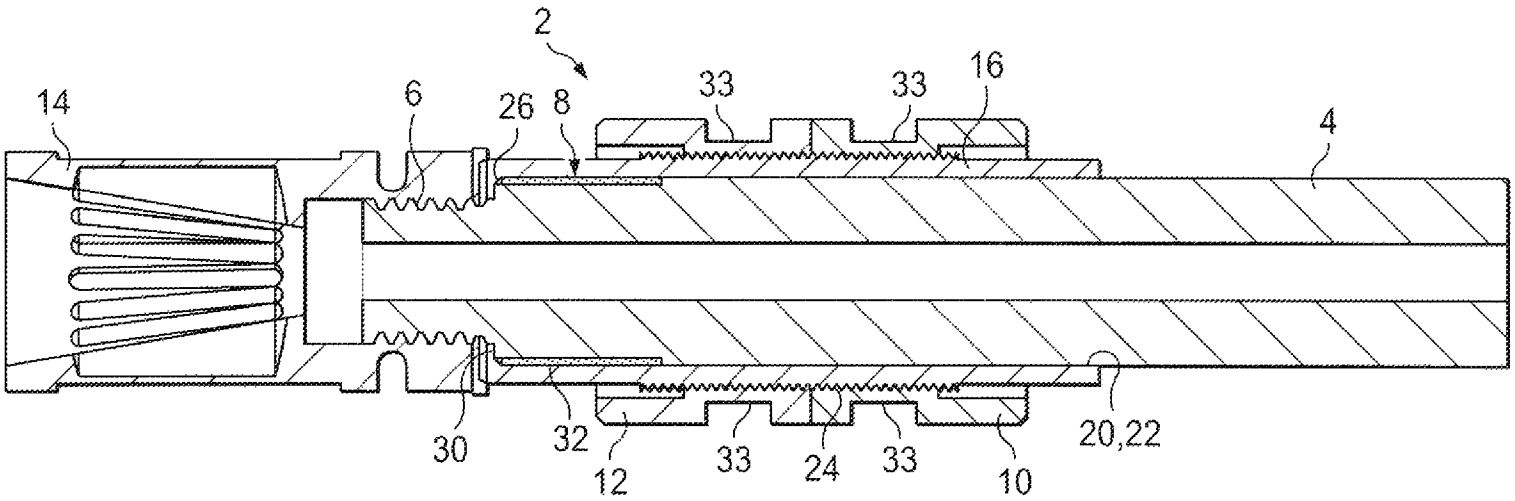
FIG. 2 is a cutaway elevational side view of the inventive barrel harmonizing assembly 2 as seen from perspective 2-2 shown in FIG. 3.
Figure 4:
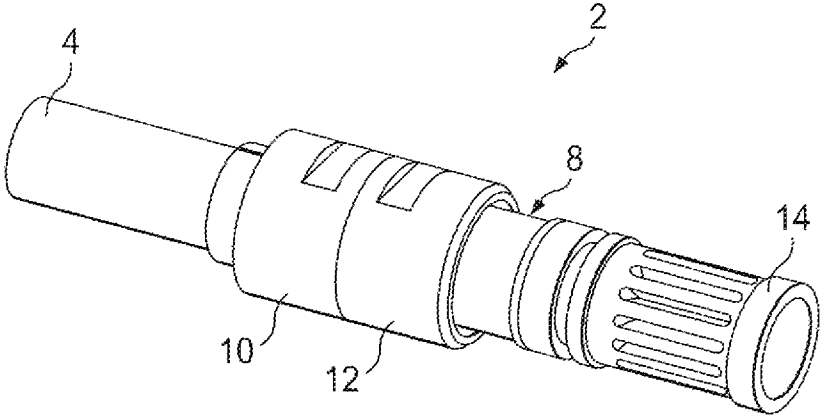
FIG. 4 is a perspective view of the inventive barrel harmonizing assembly 2.
Figure 3:
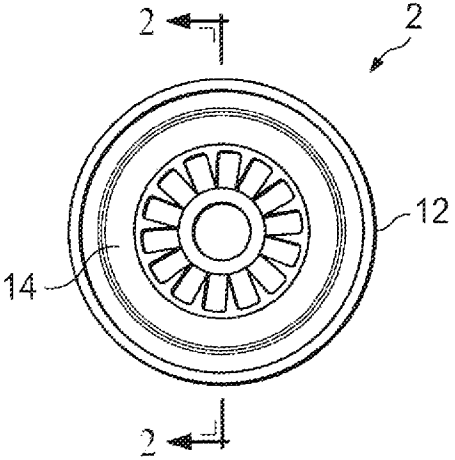
FIG. 3 is an elevational forward end view of the inventive barrel harmonizing assembly 2.

An embodiment 2 of the inventive barrel harmonizing assembly is illustrated in FIGS. 1-4. The inventive barrel harmonizing assembly 2 can be installed and used on generally any rifle or other firearm of a type where the barrel 4 of the firearm has, or is modified to have, a forward end segment 6 which (a) has a smaller outer diameter than the remainder of the barrel 4 and (b) is externally threaded.

The inventive barrel harmonizing assembly 2 preferably comprises: a cylindrical harmonizer sleeve 8 which is positioned around but preferably does not extend forwardly beyond the forward end of the barrel 4; a first tuning nut 10 which is threadedly received around, and is longitudinally repositionable along, the longitudinal exterior 15 of the cylindrical sleeve 8; a second tuning nut 12 which is threadedly received around, and is longitudinally repositionable along, the longitudinal exterior 15 of the cylindrical sleeve 8; a threaded retainer 14 which is threadedly received on the externally threaded forward end segment 6 of the barrel 4 to retain the cylindrical harmonizing sleeve 8 on a longitudinal portion 16 of the barrel 4 which extends rearwardly from the externally threaded forward end segment 6 of the barrel 4; and a bonding agent 18 which, although optional, is also preferably used to retain the cylindrical sleeve 8 in fixed position on the barrel 4.

The cylindrical harmonizer sleeve 8 of the inventive assembly 2 preferably comprises: a cylindrical internal passageway 20 which extends longitudinally through the cylindrical sleeve 8 and has an interior surface 22; threads 24 which extend longitudinally along at least a portion, preferably at least most, of the longitudinal exterior 15 of the cylindrical sleeve 8; and an inwardly extending radial shoulder 26 at the forward longitudinal end 28 of the cylindrical harmonizer sleeve 8.

The longitudinal length of the cylindrical harmonizer sleeve 8 is preferably in the range of from about 1.5 to about 3.0 inches and is more preferably about 2 inches.

The inside diameter of the inwardly extending radial shoulder 26 at the forward longitudinal end 28 of the cylindrical harmonizer sleeve 8 is preferably such that (a) the inside diameter of the forward interior shoulder 26 of the sleeve 8 is large enough to allow the externally threaded forward end segment 6 of the barrel 4 to project forwardly through the interior shoulder 26 of the sleeve 8 when the sleeve 8 is placed on the barrel 4 but (b) the inside diameter of the forward interior shoulder 26 of the sleeve 8 is smaller than the outside diameter of an exterior shoulder 30 which extends around the barrel 4 so that the forward interior shoulder 26 of the sleeve 8 will abut or will otherwise be retained by the exterior shoulder 30 of the barrel 4. The exterior shoulder 30 of the barrel 4 is formed around the barrel 4 at the rearward longitudinal end of the externally threaded forward end segment 6 of the barrel 4.

The tuning nuts 10 and 12 which are threadedly positioned around the cylindrical harmonizer sleeve 8 of the inventive assembly 2 serve as adjustable tuning weights which are preferably tightenable against each other so that the tuning nuts 10 and 12 can be locked at any desired longitudinal tuning position on the exterior of the cylindrical harmonizer sleeve 8. The tuning nuts 10 and 12 are preferably locknuts or jam nuts. Each of the tuning nuts 10 and 12 is preferably from about 0.5 to about 1.0 inch, more preferably about 0.75 inch, in longitudinal width. Each of the tuning nuts also preferably has at least one opposing pair of lateral exterior flats 33 for tightening and loosening the tuning nuts 10 and 12 with a wrench.

The bonding agent 18, which is an optional but preferred component of the inventive assembly 2, is applied between the interior cylindrical surface 22 of the harmonizer sleeve 8 and the exterior cylindrical surface 32 of the barrel 4. The bonding agent 18 assists in holding the cylindrical sleeve 8 in fixed position on the barrel 4 and prevents the sleeve 8 from rotating. The bonding agent 8 can also further assist in improving the harmonics of the barrel 4 by dampening vibrations.

Examples of suitable bonding agents 8 include, but are not limited to, high temperature adhesive ceramic cements such as Rocksett High Temperature Adhesive, high temperature silicone bonding agents such as MSHLE Original Aluminum Silicone Sealant, and high temperature epoxy bonding agents such as J.B. WELD.

The threaded retainer 14 used in the inventive harmonizing assembly 2 can be any type of nut or other threaded element which can be threadedly received on the externally threaded forward segment 6 of the barrel 4 for clamping or otherwise retaining the inwardly extending radial shoulder 26 at the forward longitudinal end 28 of the cylindrical harmonizer sleeve 8 between the threaded retainer 14 and the exterior shoulder 30 of the barrel 4. The inventive harmonizer assembly 2 preferably also includes a washer 34 which is positioned on the externally threaded forward end segment 6 of the barrel 4 between the exterior shoulder 30 of the barrel 4 and the threaded retainer 14.

In one aspect, the threaded retainer 14 can be a lock nut or a jam nut which will effectively lock the cylindrical harmonizer sleeve 8 in place on the barrel 4 when the nut is tightened. In another aspect, the threaded retainer can alternatively be a flash hider, a suppressor, a recoil compensator, or other threaded device which will further improve the harmonics of the barrel 4 and/or provide other benefits.

In the method of the present invention, the inventive harmonizing assembly 2 is preferably first installed on the barrel 4 of a firearm by: (1) applying the bonding agent 18 to the interior cylindrical surface 22 of the harmonizer sleeve 8 and/or the exterior cylindrical surface 32 of the longitudinal portion 16 of the barrel 4; (2) placing the harmonizer sleeve 8, with the tuning nuts 10 and 12 thereon, on the longitudinal portion 16 of the barrel 4 such that the inwardly extending radial shoulder 26 at the forward end 28 of the sleeve 8 abuts the exterior shoulder 30 which is formed around the barrel 4 at the rearward end of the externally threaded forward end segment 6 of the barrel 4; (3) placing the washer 34 on the forward end segment 6 of the barrel 4; and (4) tightening the threaded retainer 14 on the externally threaded forward end segment 6 of the barrel 4 such that the inwardly extending radial shoulder 26 at the forward end 28 of the harmonizer sleeve 8 is clamped between the washer 34 and the exterior shoulder 30 which is formed around the barrel 4.

Next, the inventive harmonizer assembly 2 is used to tune the barrel 4 of the firearm by: (a) firing a plurality of shots at a target to determine a grouping of the shots; (b) if the first grouping of the shots is not sufficiently tight, threadedly moving the first and second tuning nuts 10 and 12 to a new longitudinal tuning location on the exterior of the harmonizer sleeve 8; (c) tightening one of the tuning nuts 10 or 12 against the other to lock the tuning nuts 10 and 12 in position at the new longitudinal tuning location; (d) firing a plurality of shots at a target to determine a second grouping of the shots; (e) if the second grouping of the shots is not sufficiently tight, threadedly moving the first and second tuning nuts 10 and 12 to a second new longitudinal tuning location on the exterior of the harmonizer sleeve 8; (f) tightening one of the tuning nuts 10 or 12 against the other to lock the tuning nuts 10 and 12 in position at the second new longitudinal tuning location; (g) firing a plurality of shots at a target to determine a third grouping of the shots; and (h) repeating this procedure until a grouping of shots of a desired tightness is obtained.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the claims.

What is claimed is:

1. A harmonizing assembly comprising:

a cylindrical sleeve having an internal passageway extending therethrough configured to receive, and to position the cylindrical sleeve around an exterior of, a longitudinal portion of a barrel of a firearm, the cylindrical sleeve having threads around at least a portion of a longitudinal exterior of the cylindrical sleeve;

a first tuning nut which is threadedly received around, and is longitudinally repositionable along, the longitudinal exterior of the cylindrical sleeve;

a second tuning nut which is threadedly received around, and is longitudinally repositionable along, the longitudinal exterior of the cylindrical sleeve, the second tuning nut being threadedly tightenable against the first tuning nut; and an inwardly extending radial shoulder at a forward longitudinal end of the cylindrical sleeve, the inwardly extending radial shoulder being configured to deliver an externally threaded forward end segment of the barrel through the inwardly extending radial shoulder at the forward longitudinal end of the cylindrical sleeve such that the inwardly extending radial shoulder is retained by an exterior shoulder of the barrel, wherein the externally threaded forward end segment of the barrel has a reduced outer diameter and the exterior shoulder of the barrel is located at a reward longitudinal end of the externally threaded forward end segment of the barrel.

2. The harmonizing assembly of claim 1 further comprising a threaded retainer which is threadedly receivable on the externally threaded forward end segment of the barrel to retain the cylindrical sleeve around the exterior of the longitudinal portion of the barrel.

3. The harmonizing assembly of claim 2 further comprising a washer positioned between the threaded retainer and the forward longitudinal end of the cylindrical sleeve.

4. The harmonizing assembly of claim 2 wherein the threaded retainer is a locknut, a jam nut, a flash hider, a recoil compensator, or a suppressor.

5. The harmonizing assembly of claim 1 further comprising a bonding agent applied between an interior surface of the internal passageway of the cylindrical sleeve and the exterior of the longitudinal portion of the barrel.

6. The harmonizing assembly of claim 5 wherein the bonding agent is a high temperature adhesive ceramic cement, a high temperature silicone bonding agent, or a high temperature epoxy bonding agent.

7. The harmonizing assembly of claim 1 wherein:

the cylindrical sleeve has a longitudinal length of from 1.5 to 3.0 inches;

the first tuning nut has a longitudinal width of from 0.5 to 1.0 inch; and the second tuning nut has a longitudinal width of from 0.5 to 1.0 inch.

8. An assembly for a firearm comprising:

a barrel of a firearm;

a cylindrical harmonizer sleeve positioned around an exterior of a longitudinal portion of the barrel, the cylindrical harmonizer sleeve having threads around at least a portion of a longitudinal exterior of the cylindrical harmonizer sleeve;

a first tuning nut which is threadedly received around, and is longitudinally repositionable along, the longitudinal exterior of the cylindrical harmonizer sleeve;

a second tuning nut which is threadedly received around, and is longitudinally repositionable along, the longitudinal exterior of the cylindrical sleeve, the second tuning nut being threadedly tightenable against the first tuning nut; and the cylindrical harmonizer sleeve having an inwardly extending radial shoulder at a forward longitudinal end of the cylindrical harmonizer sleeve through which an externally threaded forward end segment of the barrel projects, wherein the inwardly extending radial shoulder at the forward longitudinal end of the cylindrical harmonizer sleeve is retained by an exterior shoulder of the barrel, the externally threaded forward end segment of the barrel has a reduced outer diameter, and the exterior shoulder of the barrel is located at a reward longitudinal end of the externally threaded forward end segment of the barrel.

9. The assembly of claim 8 further comprising a threaded retainer which is threadedly received on the externally threaded forward end segment of the barrel.

10. The assembly of claim 9 further comprising a washer which is held by the threaded retainer against the forward longitudinal end of the cylindrical harmonizer sleeve.

11. The assembly of claim 9 wherein the threaded retainer is a locknut, a jam nut, a flash hider, a recoil compensator, or a suppressor.

12. The assembly of claim 8 further comprising a bonding agent between an interior surface of the cylindrical harmonizer sleeve and the exterior of the longitudinal portion of the barrel.

13. The assembly of claim 12 wherein the bonding agent is a high temperature adhesive ceramic cement, a high temperature silicone bonding agent, or a high temperature epoxy bonding agent.

14. The assembly of claim 8 wherein:

the cylindrical harmonizer sleeve has a longitudinal length of from 1.5 to 3.0 inches;

the first tuning nut has a longitudinal width of from 0.5 to 1.0 inch; and the second tuning nut has a longitudinal width of from 0.5 to 1.0 inch.

15. A method of harmonizing a barrel of a firearm comprising the steps of:

a) placing a harmonizing sleeve assembly on the barrel comprising a cylindrical sleeve which is positioned around an exterior of a longitudinal portion of the barrel, the cylindrical sleeve having threads around at least a portion of a longitudinal exterior of the cylindrical sleeve and the cylindrical sleeve having an inwardly extending radial shoulder at a forward longitudinal end of the cylindrical sleeve through which an externally threaded forward end segment of the barrel projects, the externally threaded forward end segment of the barrel having a reduced outer diameter, a first tuning nut which is threadedly positioned around the longitudinal exterior of the cylindrical sleeve at a longitudinal tuning location, and a second tuning nut which is threadedly positioned around the longitudinal exterior of the cylindrical sleeve and is tightened against the first tuning nut at the longitudinal tuning location;

b) retaining the harmonizing sleeve assembly on the barrel by threadedly tightening a threaded retainer on the externally threaded forward end segment of the barrel such that the inwardly extending radial shoulder at the forward longitudinal end of the cylindrical sleeve is held in fixed position between the threaded retainer and an exterior shoulder of the barrel which is located at a reward longitudinal end of the externally threaded forward end segment of the barrel;

c) tiring a plurality of shots from the barrel to determine a grouping of the shots; and d) moving the first and second tuning nuts longitudinally to a different longitudinal tuning location around the exterior of the cylindrical sleeve to obtain a tighter grouping of shots.

16. The method of claim 15 wherein the threaded retainer is a locknut, a jam nut, a flash hider, a recoil compensator, or a suppressor.

17. The method of claim 15 further comprising applying a bonding agent between an interior surface of the cylindrical sleeve and the exterior of the longitudinal portion of the barrel.

18. The method of claim 17 wherein the bonding agent is a high temperature adhesive ceramic cement, a high temperature silicone bonding agent, or a high temperature epoxy bonding agent.

19. The method of claim 15 wherein:

the cylindrical sleeve has a longitudinal length of from 1.5 to 3.0 inches;

the first tuning nut has a longitudinal width of from 0.5 to 1.0 inch; and the second tuning nut has a longitudinal width of from 0.5 to 1.0 inch.

20. The method of claim 15 wherein step (b) comprises the steps of (i) placing a washer on the externally threaded forward end segment of the barrel between the forward longitudinal end of the cylindrical sleeve and the threaded retainer and (b) clamping the inwardly extending radial shoulder at the forward longitudinal end of the cylindrical sleeve between the washer and the exterior shoulder of the barrel by tightening the threaded retainer on the externally threaded forward end segment of the barrel.

* * * * *